US012338018B2

(12) United States Patent
Lambertz et al.

(10) Patent No.: US 12,338,018 B2
(45) Date of Patent: Jun. 24, 2025

(54) DEVICE AND METHOD FOR TRANSPORTING READY-CUT AND FILLED HOSE PIECES

(71) Applicant: Teepack Spezialmaschinen GmbH & Co. KG, Meerbusch (DE)

(72) Inventors: Stefan Lambertz, Hürth (DE); Hans Knops, Krefeld (DE)

(73) Assignee: Teepack Spezialmaschinen GmbH & Co. KG, Meerbusch (DE)

( * ) Notice: Subject to any disclaimer, the term of this patent is extended or adjusted under 35 U.S.C. 154(b) by 295 days.

(21) Appl. No.: 17/726,085

(22) Filed: Apr. 21, 2022

(65) Prior Publication Data

US 2022/0340317 A1 Oct. 27, 2022

(30) Foreign Application Priority Data

Apr. 23, 2021 (EP) ..... 21170188

(51) Int. Cl.
*B65B 29/04* (2006.01)
*B65B 29/02* (2006.01)
(Continued)

(52) U.S. Cl.
CPC ..... *B65B 29/04* (2013.01); *B65B 29/028* (2017.08); *B65B 41/06* (2013.01); *B65B 43/60* (2013.01); *B65B 63/005* (2013.01)

(58) Field of Classification Search
CPC ..... B65B 29/04; B65B 29/028; B65B 41/06; B65B 43/60; B65B 63/005
See application file for complete search history.

(56) References Cited

U.S. PATENT DOCUMENTS 2,933,871 A * 4/1960 Brook ..... B65B 11/38 53/234
3,968,627 A * 7/1976 Seragnoli ..... B65B 11/34 53/370

(Continued)

FOREIGN PATENT DOCUMENTS

DE 3807763 A1 9/1988
EP 1731295 A1 * 12/2006 ..... B31D 1/023

(Continued)

OTHER PUBLICATIONS

Extended European Seach Report dated Oct. 15, 2021 in connection with European Patent Application No. 21170188.3, 11 pages including English translation.

*Primary Examiner* — Andrew M Tecco
*Assistant Examiner* — Nicholas E Igbokwe
(74) *Attorney, Agent, or Firm* — Dorsey & Whitney LLP

(57) ABSTRACT

The present invention relates to a device for transporting ready-cut and filled hose pieces within a machine for producing bags filled with brewable material, having at least one transport wheel which includes, distributed over its circumference, a plurality of holders each holding the bag, wherein an insertion station in which one of said hose pieces is inserted into said holder in a radial direction to form a bag with at least one chamber between a head and a bottom of said bag, a label feeding station in which a label is fed to said head, a connecting station, in which a thread is connected to the label and/or the bag, and a removing station, in which the bag is removed from the transport wheel, are provided distributed in the circumferential direction around the transport wheel.

19 Claims, 12 Drawing Sheets

(51) Int. Cl.

| | |
|---|---|
| ***B65B 41/06*** | (2006.01) |
| ***B65B 43/60*** | (2006.01) |
| ***B65B 63/00*** | (2006.01) |

(56) References Cited

U.S. PATENT DOCUMENTS

| | | | | | |
|---|---|---|---|---|---|
| 5,870,880 | A * | 2/1999 | Romagnoli | B65D 85/808 | 53/134.2 |
| 2004/0226263 | A1 * | 11/2004 | Romagnoli | B65B 29/04 | 53/550 |
| 2011/0047937 | A1 * | 3/2011 | Tsuji | B29C 66/4312 | 53/413 |
| 2017/0240306 | A1 * | 8/2017 | Spatafora | B65D 85/808 | |
| 2018/0290838 | A1 * | 10/2018 | Bianchi | B65B 43/50 | |

FOREIGN PATENT DOCUMENTS

| | | | | |
|---|---|---|---|---|
| EP | 1731295 | B1 | 3/2008 | |
| EP | 2681119 | B1 | 12/2014 | |
| EP | 3733383 | A1 | 11/2020 | |
| EP | 3733384 | A1 | 11/2020 | |
| WO | WO-2012117308 | A1 * | 9/2012 | B65B 11/28 |

* cited by examiner

DEVICE AND METHOD FOR TRANSPORTING READY-CUT AND FILLED HOSE PIECES

CROSS REFERENCE TO RELATED APPLICATIONS

This application claims benefit of priority pursuant to 35 U.S.C. § 119(a) of European patent application no. 21170188.3 filed 23 Apr. 2021, which is hereby incorporated herein by reference in its entirety for all purposes.

BACKGROUND OF THE INVENTION

The present invention relates to a device and a method for transporting ready-cut and filled hose pieces within a machine for producing bags filled with brewable material.

A generic device is known from EP 2 681 119 B1 and EP 3 733 384 A1. This device has a transport wheel, which comprises several bag receptacles distributed around its circumference.

In this previously known device, the cut-to-size and filled hose piece is inserted radially into the transport wheel to form a bag from the hose piece. In this process, the hose piece is formed in such a way that a chamber of a bag is produced which extends radially with respect to the transport wheel, wherein the bottom of the bag is located radially on the inside and the top of the bag is located radially on the outside. This station is also referred to as the insertion station in the scope of the description of the present invention. In this context, the cut-to-size and filled hose piece can also be formed as a single-chamber or double-chamber bag within the scope of the invention. In any case, downstream of the insertion station, the initially flat blank is formed in such a way that the chamber and thus the shape of the bag is essentially predetermined. The head is exposed in the region of the outer circumference of the transport wheel. In subsequent processing steps and while the transport wheel is rotating, a label is fed to the head of the bag according to the prior art and connected to the head of the bag.

The bag is then wrapped in an elongated piece of an envelope. This envelope is basically placed around the bag in a U-shape. The opposing edges of the envelope are then welded together to seal the bag completely in the envelope. The envelope is formed by a film through which the bag is packed inside the envelope in an aroma-tight manner. In the solution according to EP 2 681 119 B1, the bag is first removed from the transport wheel in the radial direction and inserted radially into the transport wheel with the bottom facing forward, as a result of which the envelope is wrapped around the bag. According to the solution described in EP 3 733 384 A1, the bag is swiveled in the transport wheel so that when the bag is removed from the transport wheel, the bag is removed from the transport wheel with the bottom facing forward and is thereby wrapped in the envelope.

Handling the thread inside the transport wheel is not entirely unproblematic. The transport wheel must rotate at a relatively high speed at high productivity. The transport wheel has a large number of clamps, edges, joints and the like on which the thread can get caught.

SUMMARY OF THE INVENTION

The present invention is based on the problem of providing a device and a method of the kind mentioned above, in which the thread is handled with greater safety in the region of the transport wheel.

In order to solve this problem with respect to the device, the present invention proposes a device with the feature of claim 1.

In a manner generally known, this device has a transport wheel which comprises a plurality of holders distributed around its circumference, each of which holds the bag. Associated with the transport wheel is an insertion station in which one of the hose pieces is inserted into the holder in a radial direction to form a bag with at least one chamber. This hose piece cut-to-size and filled with breable material is already connected to one end of the thread as the hose piece is inserted into the transport wheel. The chamber extends between a head and a bottom of the bag. In this process, the bottom of the bag is normally located radially inwards. The head of the bag is already located in the insertion station, preferably in the region of the outer circumference of the transport wheel. A label feeding station is also provided, in which a label is fed to the head. Furthermore, a connecting station is realized, in which a thread is connected to the label and/or the bag. Finally, in a manner known per se, a removing station is provided in which the bag is removed from the transport wheel. The aforementioned stations are usually provided distributed in the circumferential direction around the transport wheel. However, the label feeding station and the connecting station can be provided at a uniform position between the insertion station and the removing station. At the respective stations, there is an action on the bag to achieve the respective performance result in the respective station.

However, in the solution according to the invention, the bag can be moved past the respective stations and/or away from or towards the respective station continuously or intermittently by rotating the transport wheel.

According to the solution of the present invention with respect to the device, each holder is associated with a thread channel which can be connected to a vacuum source and a overpressure source. The thread channel is adapted to receive a thread. This is usually a piece of thread. Normally, the thread is already connected to the bag, i.e. to the hose piece circumferentially surrounding the bag, when it is received in the thread channel. Accordingly, the hose piece with the thread attached to it is already inserted into the transport wheel in the insertion station.

In the method according to the invention as claimed in claim 8, the thread is temporarily accommodated in the thread channel before the label and/or bag is connected to the thread and during the rotation of the transport wheel.

In this context, a vacuum threshold usually acts during the accommodation of the thread in the thread channel, by which the thread is not only sucked into the thread channel, but is also held within the thread channel during the rotation of the transport wheel. Only when the thread is connected to the label and/or the bag, the thread is blown out of the thread channel, so that it is available outside the thread channel for attachment to the label and/or the bag.

According to a preferred further development of the device according to the invention, the thread channel has a thread opening for inserting the thread. This is preferably located adjacent to a receptacle for the actual bag in the form of a holding shaft, for example. The thread channel has a remote air guide opening which, due to the rotation of the transport wheel, can be brought into operative connection with a vacuum opening or an overpressure opening. The thread channel then usually has only two openings. The thread is fed into the thread opening. The air guide opening conveys the pressure level acting in the thread channel.

The operative connection between the air guide opening and a usually stationary vacuum opening as well as a usually also stationary overpressure opening takes place due to the rotation of the transport wheel. Thus, the desired pressure level in the thread channel can be set by the rotation of the transport wheel depending on the respective station at which the respective holder is located. According to this, no complex valves or the like are necessary. The vacuum opening can have a constant vacuum in itself. The same applies to the overpressure at the overpressure opening. The desired pressures are inevitably set in the thread channel simply by passing the air guide opening past the vacuum opening or the overpressure opening. This results in directed flows in the thread channel through which the thread is laid, conveyed or held.

In view of this, the air guide opening is preferably recessed on a surface of the holder which extends radially with respect to the axis of rotation of the transport wheel. The vacuum opening or overpressure opening in operative connection with the air guide opening is provided opposite the air guide opening in each case. Thus, the vacuum opening and the overpressure opening are usually provided in a common plane and are exposed there, which extends parallel to the radial plane of the transport wheel.

With regard to a longer effectiveness of the vacuum, the vacuum opening is configured as an elongated open channel regularly as an annular segment. The air guide opening is preferably in operative connection with the vacuum opening during the rotation of the transport wheel from the insertion station to a position in front of the connecting station. As a result, the thread is effectively sucked into the thread channel during the rotation of the transport wheel via the acting vacuum and held there. This further development illustrates the concept of controlling the pressure conditions in the thread channel without the need for valves or the like. The pressure conditions in the thread channel desired for the treatment and processing of the thread on the transport wheel are set solely by the rotational movement of the transport wheel into the holding channel, in that its vacuum opening is brought into operative connection with the vacuum opening and/or the overpressure opening depending on the angular position of the transport wheel, or is arranged in such a way that no working pressure is set in the thread channel. This is superfluous, for example, after the thread has been connected to the bag and the label or has been fixed relative to the bag on the transport wheel. The same applies to angular positions of the transport wheel in which the holder is prepared, for example, to receive another bag after delivery to the removing station.

In order to attach the label with the aid of the thread, the thread channel in the connecting station is in operative connection with the overpressure opening. The connecting station has a thread guide which can be arranged opposite the thread opening of the thread channel with the label in between. This thread guide receives the thread blown out of the thread channel and deflects it. Due to the acting overpressure, the thread can be deflected several times and blown through the plane containing the label, so that the thread is guided past the label and/or through recesses within the label and knotted with the label in this way. Details of this can be found in EP 1 731 295 B1, the disclosure of which is incorporated by this reference into the disclosure of the present application. In any case, the previously discussed further development leads to a knot formed by an air guide through which the label is connected to the thread. In order to create a greater proximity between the label and the bag, at least the portion of the thread channel comprising the thread opening is movably provided in order to be brought closer to the head of the bag after insertion of the bag into the receptacle for attaching the thread to the label in the connecting station. This embodiment allows the label to be connected to the bag in closer proximity to the same, and consequently or in a subsequent station to be attached to the bag in such a way that the thread and the label can be handled as a unit at least until they are wrapped in the envelope in the course of a removal of the bag, thread and label. A section of the thread channel forming the thread opening can be pivotally arranged on the holder for this purpose.

According to a preferred further development of the present invention, the transport wheel has a bore for each holder. In this bore, an axle body carrying the holder is mounted so as to be pivotable about a pivot axis. Furthermore, a guide is provided which imprints an orientation on the holder with respect to the pivot axis during rotation of the transport wheel. This allows, for example, the holder as a whole to be pivoted as the transport wheel rotates, so that when the bag is inserted into the holder the bottom is at the front in the insertion direction, while at the removing station the bag is removed with the bottom at the front by a pivoting movement of the holder of substantially 180°. This allows the advantages according to EP 3 733 384 B3 to be achieved. However, the guide also effects that an air guide opening of the thread channel, which is arranged eccentrically to the pivot axis, is in operative connection with the vacuum opening in the insertion station and with the overpressure opening in the connecting station. The orientation of the holder in relation to the pivot axis can remain the same in the insertion station and in the connecting station. However, the vacuum opening can also be at a different radial distance from the axis of rotation of the transport wheel than the overpressure opening, so that by pivoting the holder about the pivot axis, the air guide opening can optionally be brought into operative connection with the vacuum opening or the overpressure opening.

In order to determine the position with respect to the pivot axis depending on the rotational movement of the transport wheel, the axle body preferably has at least one guide arm extending transversely to the pivot axis of the axle body, the free end of which is provided in a guide. For this purpose, the guide arm usually has a guide pin which is guided in a guide groove recessed in a disc provided on the side of the transport wheel opposite the holder. This guide disc forms the vacuum opening or the overpressure opening or carries means for forming the corresponding openings.

In accordance with its parallel aspect, the present invention proposes a holder for holding a bag filled with brewable material. This holder has a thread channel connectable to a pressure source. This implies that the holder has a first opening, typically provided adjacent to a receptacle of the holder for the bag, for the insertion of the thread connected at least to the label or the bag, and a second air guide opening, fluidly connectable to the pressure source, connected to this first opening via the thread channel. This means that the air guide opening can be connected to the pressure source in such a way that the pressure source influences the internal pressure in the thread channel to such an extent that a flow of the ambient air of the holder is generated in the thread channel, through which the thread is sucked into or blown out of the thread channel.

Preferably, this holder has an axle body which is mounted so that it can pivot about a pivot axis. This pivot axis is usually also the extension axis of the thread channel. Accordingly, the holder usually has an elongated axle body about which the receptacle for the bag, which can be formed by a holding shaft, for example, can be pivoted in order to pivot a usually head-side end of the bag and thus usually align it head-side so that the thread and/or the label can be connected to the bag in the desired orientation thereof.

The present invention furthermore provides a method for transporting ready-cut and filled hose pieces within a machine for producing bags filled with brewable material with a transport wheel, in which one of the hose pieces is inserted in a radial direction into a holder of the transport wheel (in an insertion station to form a bag with at least one chamber between a head (7) and a bottom of the bag, and the bag is removed from the transport wheel in a removing station, wherein between the insertion station and the removing station a label is fed to the transport wheel, which is connected to the bag by a thread. In the inventive method, the thread is accommodated in a thread channel prior to connecting for temporary accommodation during rotation of the transport wheel and is blown out of the thread channel for connecting to the label.

Preferable, the thread attached to the hose piece is sucked into the thread channel in the insertion station and is blown out of the thread channel to knot the label.

Further and according to a preferred embodiment of the inventive method the hose piece is inserted into the transport wheel with the thread attached to the hose piece.

BRIEF DESCRIPTION OF THE DRAWINGS

Further details and advantages of the present invention will be apparent from the following description of an embodiment in connection with the drawing. Therein.

DETAILED DESCRIPTION

Figure 1:
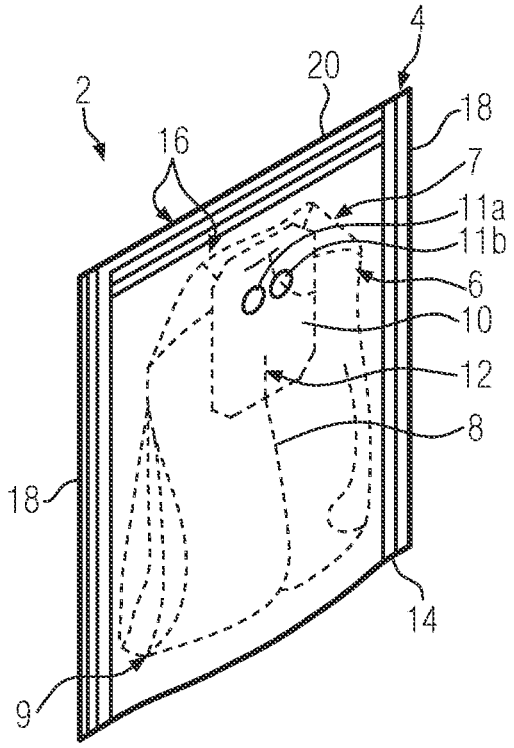
FIG. 1 shows a packaging unit which can be produced with the aid of the device according to the invention, consisting of a bag with label and thread and an envelope.

FIG. 1 shows an embodiment of a packaging unit characterized by reference sign 2, consisting of an envelope 4 in which a bag 6 with a thread 8 attached to a head 7 of the bag 6 and a label 10 arranged on the head 7 and thus opposite a bottom 9 of the bag 6 configured as a double-chamber bag are accommodated. The thread 8 is thereby on the one hand knotted to the label 10 and on the other hand passed through a slit 12 of the label 10 and accordingly secured to the label 10. The content of the envelope is produced in this way at the transport wheel described below.

The envelope 4 comprises an elongated piece of aroma-tight film folded over a fold 14 to form two abutting legs 16, and sealed over two parallel longitudinal welds 18 and a transverse weld 20.

The completion of the bag 6 accommodated in the envelope 4 together with the label 10 takes place at the transport wheel described below with reference to FIG. 2 et seq., which is characterized in the Figures by reference sign 100. In the views according to FIGS. 2 and 3, the transport wheel 100 rotates counterclockwise. This direction of rotation corresponds to the transport direction T. Circumferentially around the transport wheel 100, various stations are provided in which the bag 6 or the thread 8 or the label 10 is acted upon. At reference sign 102, an insertion station is provided in which the bag 6 is inserted into the transport wheel 100 together with the thread 8 already attached thereto. For this purpose, the transport wheel 100 has a holder 104 detailed in FIGS. 3 to 7, which comprises a receptacle in the form of a holding shaft 106 receiving the bag 6, with which a bag clamp 108 is associated, which fixes the bag 6 in the holder 104.

Figure 2:
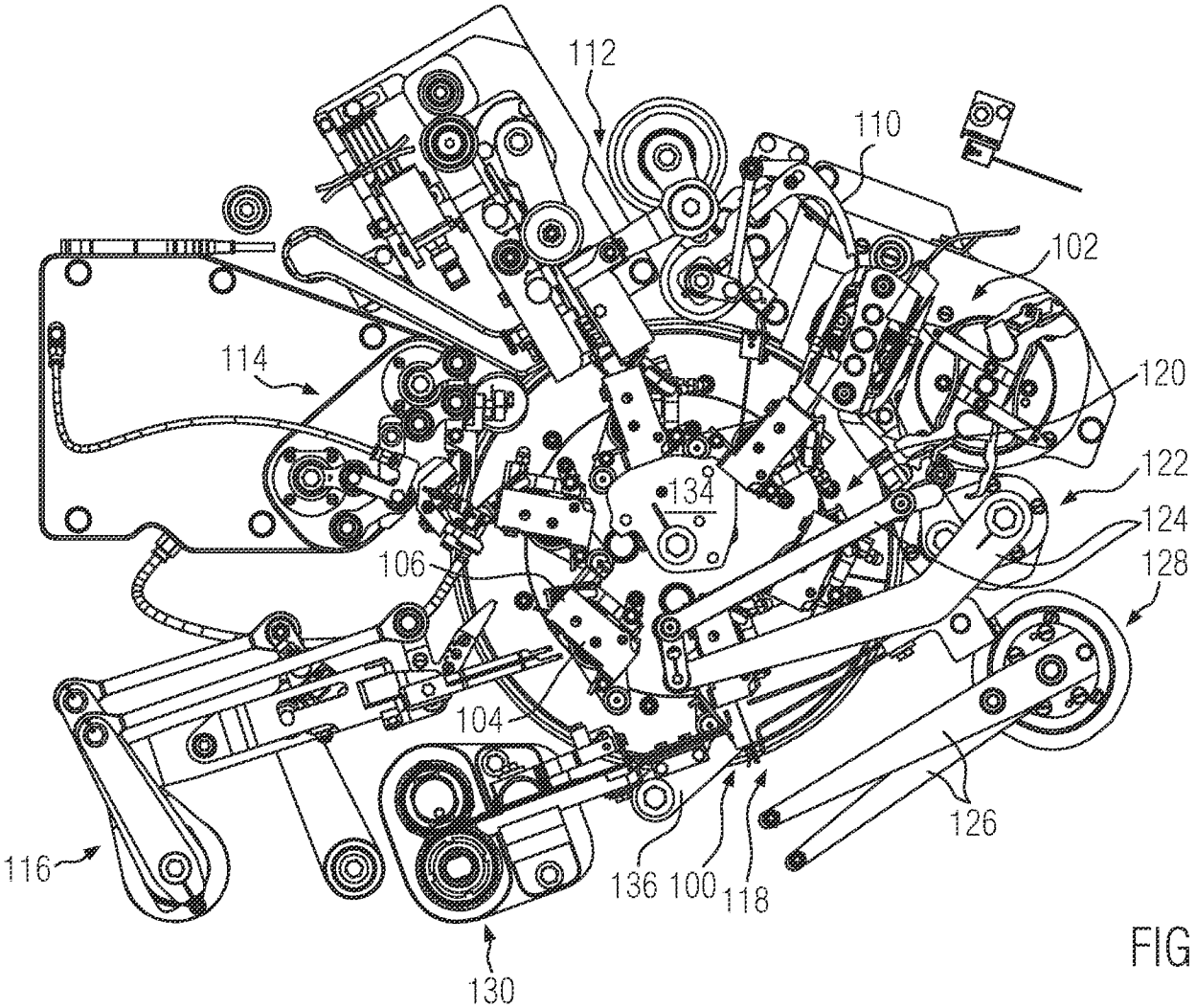
FIG. 2 shows a side view of the transport wheel according to the embodiment with various stations arranged circumferentially around the transport wheel.

As FIG. 2 illustrates, the holding shaft 106 in the insertion station 102 is aligned in a strictly radial manner so that the bag 6 with one end of the thread 8 attached thereto can be inserted into the holding shaft 106 by plugging it radially into the holder 104.

In FIG. 2, an arcuate insertion segment 110 can be seen, which is moved alternately to insert a piece of tube into the respective holder 104 as part of the formation of the bag 6, forming at least one chamber of the bag. During this process, the rotation of the transport wheel 100 is interrupted in each case. Accordingly, the transport wheel 100 is cyclically driven in rotation in the course of further processing of the bag 6, wherein the transport wheel 100 is stationary during the respective processing steps.

Adjacent to the insertion station 102 in the transport direction T, there is a label feeding station 112 in which a cut-to-size label 10 provided with a slot and holes for the thread 8 to pass through is fed to the head 7 of the bag 6. In this case, the holder 104 has a radial alignment unchanged with respect to the orientation in the insertion station 102. The same applies to a connecting station 114 following in transport direction T, in which in the embodiment the thread 8 is knotted to the label 10.

Following the connecting station 114, the holder 104 is pivoted so that this holder 104 is pivoted by 90° in the thread-securing station 116 characterized by reference sign 116 and accordingly extends tangentially relative to an axis of rotation D of the transport wheel 100. In this thread securing station 116, the thread 8 is inserted into the slot 12 of the label 10. In this way, the thread 8 is associated with the label 10 and thereafter with the bag 6 in order to prevent the thread from penetrating the sealing of the edges of the envelope material during the subsequent wrapping of the bag or even from catching on parts of the device during the further handling of the bag 4 together with the label 10 and the thread 8.

Reference sign 118 characterizes a removing station. In this removing station 118, the bag 6 is rotated by 180° relative to its alignment in the insertion station 102. While the bag 6 is inserted in the insertion station 102 with its bottom 9 forward into the holder 104, the bag 6 is pushed out with its bottom 9 forward when the bag 6 is pushed out radially in the removing station 118.

Between the removing station 118 and the inserting station 102, downstream in the transport direction of the removing station 118, there is a pivoting station 120 in which the holder 104 is pivoted by 180° so that it is appropriately aligned for receiving a new bag 6 in the insertion station 102.

Figure 3:
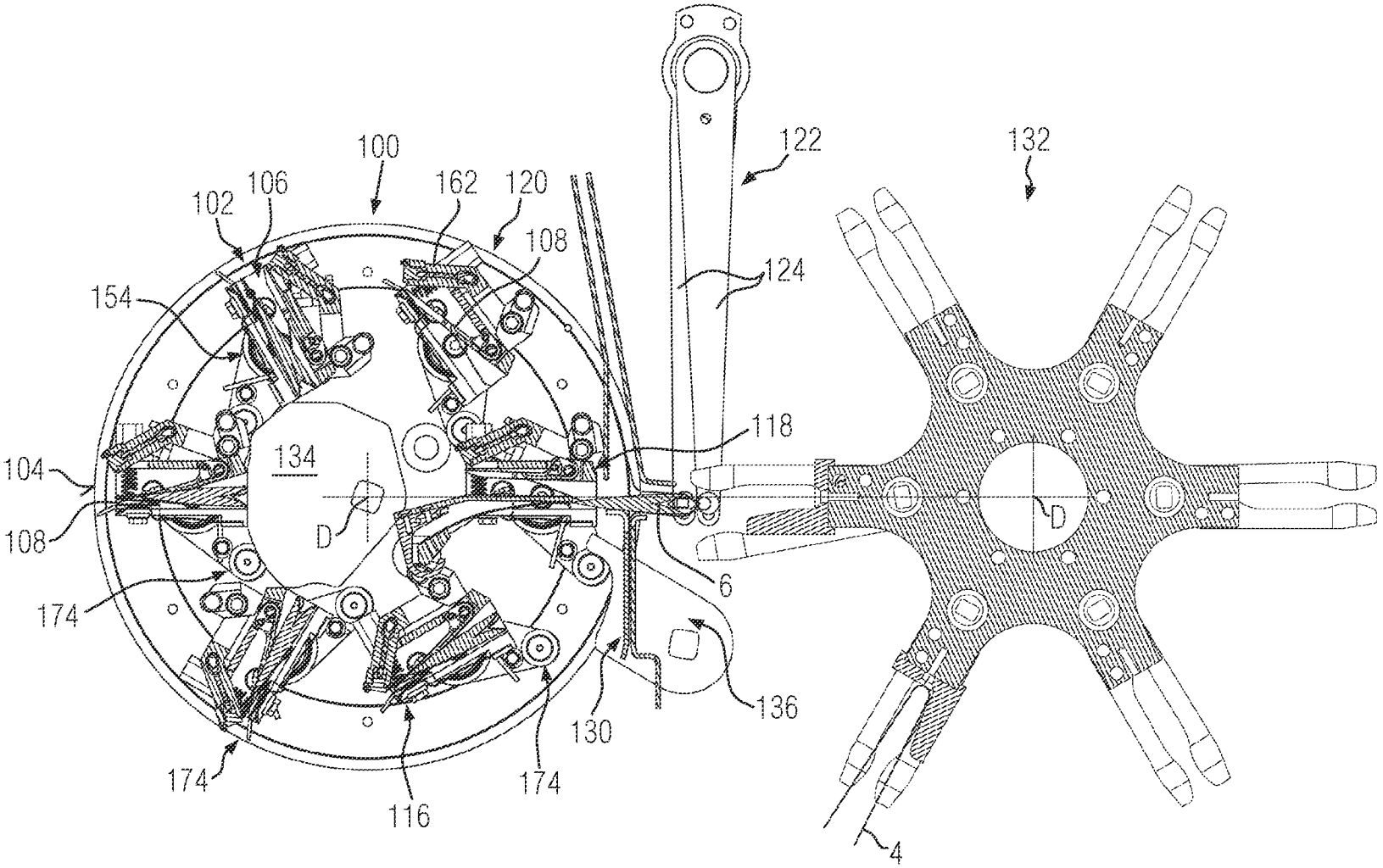
FIG. 3 shows a side view of the transport wheel according to FIG. 2 without the illustration of the components of the individual stations.

As can be seen in FIG. 3, the bag 6 is gripped in the holder 104 in the removing station by a bag handling device 122 and pulled radially out of the holder 104. For this purpose, the bag handling device 122 has leading and trailing arms 124 which clamp the bag in the region of the bottom 9 and pull it radially out of the holder 104 (see FIG. 2). These arms 124 are preceded by leading and trailing arms 126 of a wrapping material handling device 128 shown in FIG. 2, which grip the wrapping material guided tangentially over a wrapping material guide 130 past the transport wheel 100 to form the fold 14 and convey it radially out (cf. FIG. 2).

In FIG. 3, in addition to the transport wheel 100, a sealing transport wheel 132 of a sealing station is shown, which receives the envelope 4 together with the bag 6, the thread 8 and the label 10, wherein the material of the envelope 4 is already provided with the fold 14 and the transverse edge opposite the fold 14 as well as the two longitudinal edges are welded by a welding device, which is substantially opposite the transport wheel 100 with respect to the axis of rotation D of the sealing transport wheel 132, and accordingly the bag 6 is sealed in an aroma-tight manner together with the label 10 and the thread 8.

FIGS. 2 and 3 show radially inwardly a stationary inner opener cam 134 which pivots the bag clamp 108 to the open position for insertion of the bag 6 at the insertion station 102. At the removing station 118, an outer opener cam 136 is shown which also does not rotate with the transport wheel 100 and which is attached to a pivotally operable lever and lifts the bag clamp 108 off the bag 6 for removing the bag in the removing station 118.

FIGS. 4 to 11 show details of the holder 104.

Each holder 104 has an axle body 150 which is freely rotatably held on the transport wheel 100 by a ball bearing 152 which is inserted in a bore 154 (cf. FIG. 3) of the transport wheel 100 and is mounted there. The holding shaft 106 is located at the free end of the axle body 150. The bag clamp 108 is pivotally mounted in this holding shaft 106. Reference sign 156 characterizes a pivot axis for the pivoting movement of the bag clamp 108. The bag clamp 108 is non-rotatably connected to an actuating sleeve 158, which is held biased relative to the axle body 150 by a clamp spring 160. Non-rotatably connected to the actuating sleeve 158, a holder 162 is provided which carries at its free end an air knot block 164 which partially overhangs the opening of the holding shaft 106 and, in any event, is partially displaced in FIG. 6. In the closed position shown in FIG. 6, a hold-down spring 166 can be seen cooperating with the free end of the bag clamp 108 to hold it biased against the bag 6. In the open position, this hold-down spring 166 is located within a receiving cylinder 168. In the open position, the bag clamp 108 abuts the upper wall of the holding shaft 106 in FIG. 4. Opposite thereto, the opening of the holding shaft 106 is projected by outwardly inclined funnel-shaped guide projections 170.

An actuating arm 172, which is firmly connected to the actuating sleeve 158, projects radially from the actuating sleeve 158 and is provided with a cam follower 174 at its free end. This cam follower 74 interacts with the guide surfaces of the inner and outer opener cams 134, 136. This causes the bag clamp to pivot into the open position against the force of the clamp spring 160 and the hold-down spring 166. If there is no interaction between the cam follower 174 and the cam contour of the opener cam 134 or 136, the bag clamp 108 pivots into the closed position shown in FIG. 6. One end of the clamp spring 160 is supported on the actuating arm 172 (cf. FIGS. 5, 7).

At the end of the axle body 150 opposite the holding shaft 106, two guide arms 176, 178 are provided which extend radially with respect to the central longitudinal axis of the axle body 150 and are projected in the axial direction by guide pins 180, 182, which each carry cam followers 184. The guide pin 182 has a greater axial extension than the guide pin 180.

Figure 12:
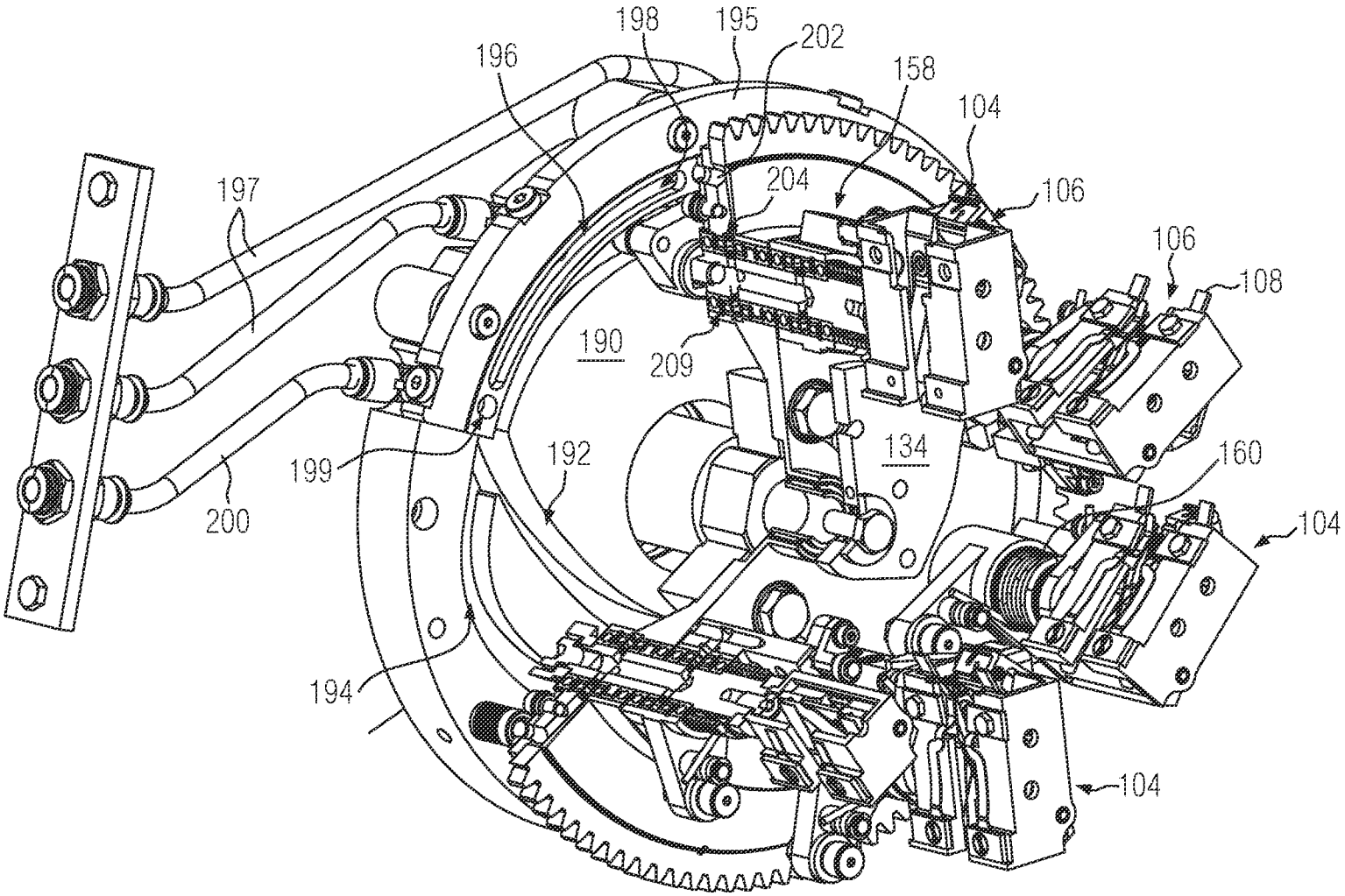
FIG. 12 shows a longitudinal sectional view along line XIII-XIII as shown in FIG. 2.
Figure 13:
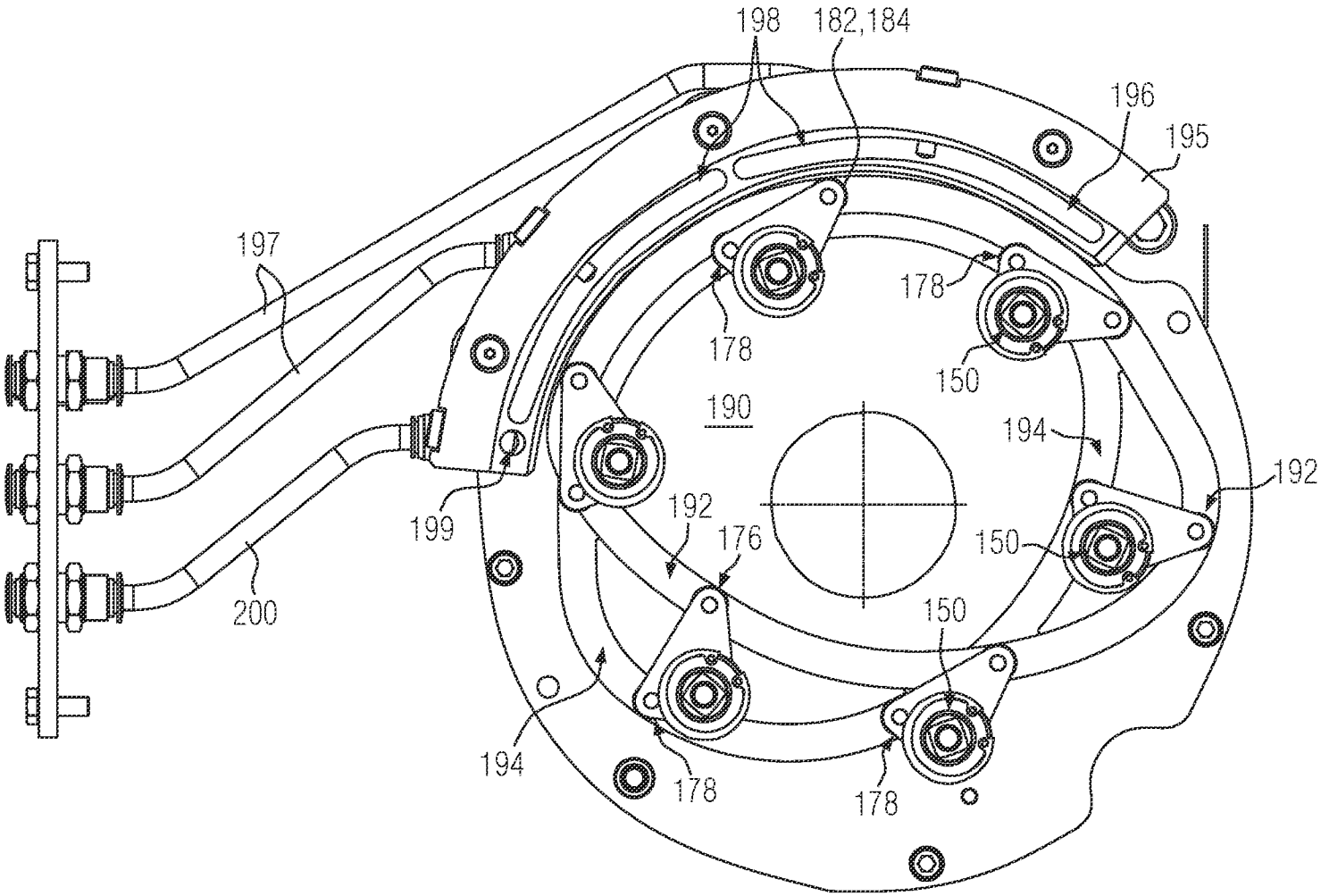
FIG. 13 shows a top view of the guide disc of the embodiment.
Figure 14:
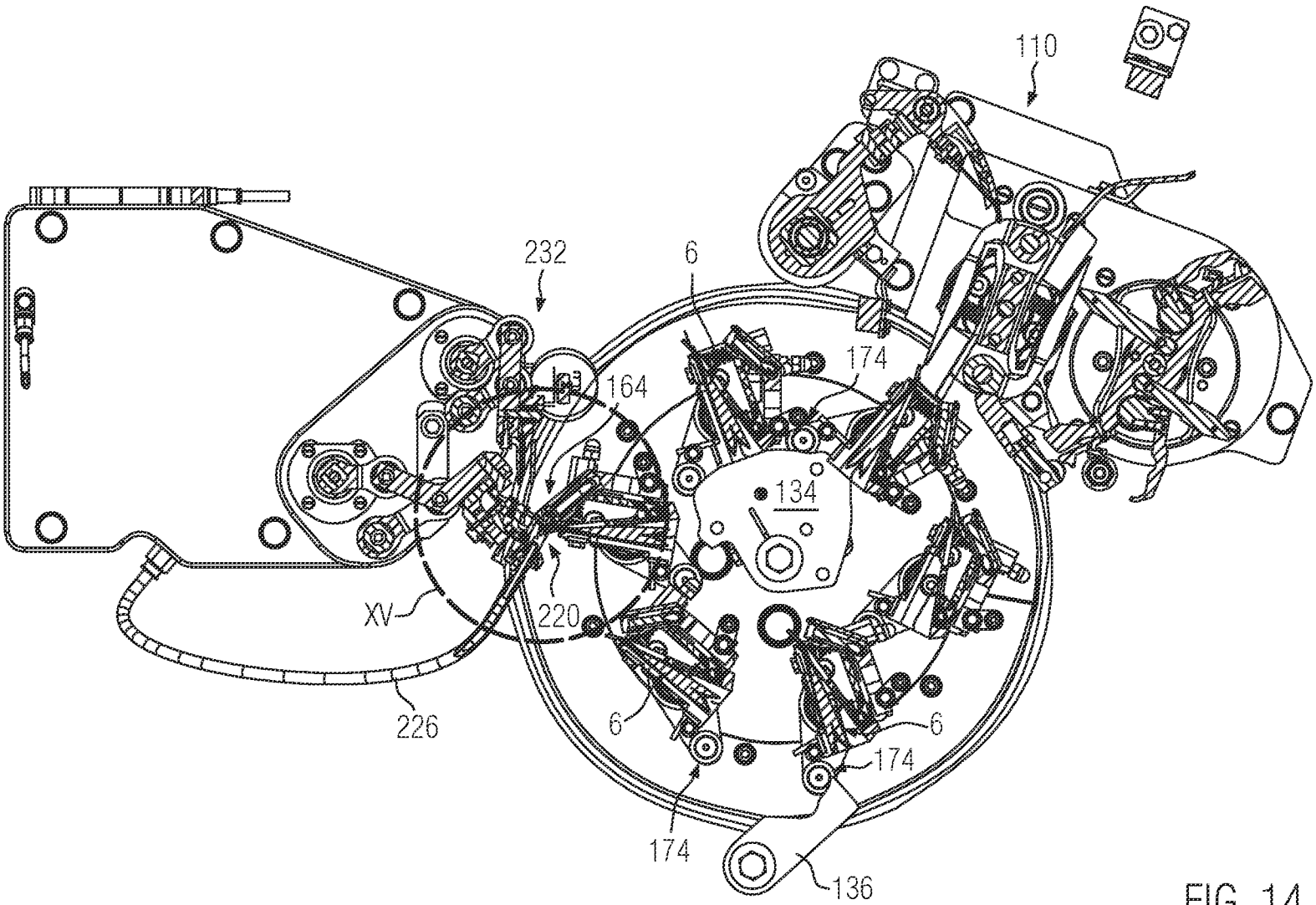
FIG. 14 shows a sectional view of holders provided on the circumference of the transport wheel.

Each guide pin 180, 182 engages in a respective guide groove which is recessed on a guide disc provided stationarily behind the transport wheel 100 in the top view according to FIGS. 2 and 3. Details of the guide disc and the grooves recessed there are shown in FIGS. 12 and 13 and described in detail below. The guide groove assigned to guide pin 182 is deeper than the guide groove assigned to guide pin 180. The grooves cross each other. They accommodate the cam followers 184 of the two guide pins 180, 182 with little play. Like the cam follower 174, the cam follower 184 also has a freely rotatable ring surface which is guided in the respective guide groove and can be brought into contact with the side walls of the groove with little friction.

Due to the rotatable mounting of the axle body 150 via the ball bearing 152 with respect to the rotating transport wheel 100 and the two guide pins 180, 182 provided eccentrically with respect to the pivot axis of the holder 104, which is formed by the central longitudinal axis of the axle body 150, the pivoting movement of the holder 104 in the context of the rotational movement of the transport wheel 100 relative to the stationary guide disc can be generated and precisely specified.

The configuration with two guide pins 180, 182 permits close and precise positive guidance of the pivoting movement of the holder 104. As the top view according to FIGS. 2 and 3 conveys, a total of six stations are provided in the circumferential direction of the transport wheel 100. Accordingly, the individual holders 104 are provided offset from each other by 60° in the circumferential direction. In this case, the holder 104 can be pivoted by 180° on a transport path of 120° or by exactly 90° on a transport path corresponding to 60°.

In the embodiment, the rotational movement of the transport wheel 100, together with the cyclic movement of the inner opener cam 134, induces the opening and closing of the bag clamp 108 in the region of the insertion station 102. In the removing station 118, the opening and closing of the bag clamp 108 is effected by pivoting the outer opener cam 136 while the transport wheel 100 is stationary. As shown in FIG. 3, the bag clamp 108 is applied to the bag 6. However, the holder 162 is held at a central position. The relative movement between the bag clamp 108 and the holder 162 is caused by the hold-down spring 166. In the label feeding station 112, the bag clamp 108 is applied to the bag 6. Meanwhile, the holder 162 is held at a central position so that the endlessly fed material forming the label 10 can be cut off in the area of the label feeding station 112 without colliding with the holder 162. The inner opener cam 134 is pivoted relative to the transport wheel 100 when it is stationary. However, it is also pivoted against its direction of rotation when the transport wheel 100 is rotating.

Opening of the bag clamp 108 is effected via a cam 186 and abutment of this cam 186 against a free lever arm 188. The cam 186 is formed by a disc which is mounted pivotally about a pivot axis 189 via a ball bearing. Accordingly, actuation of the bag clamp 108 results from pivoting of the actuating sleeve 158 caused by the opener cams 134, 136.

The label 10 fed into the label feeding station 112 is applied against the outer surface of the air knot block 164 in a manner to be detailed below.

FIGS. 12 and 13 show details of a guide disc 190 in which two circumferential recessed guide grooves of different depths are provided, wherein reference sign 192 characterizes the deeper guide groove associated with the cam follower 184, while reference sign 194 characterizes a less deeply recessed guide groove in which the cam follower 174 is received and guided. Obviously, the guide grooves 192, 194 intersect to guide the pivoting movement of the holder about the pivot axis S such that the bag 6 can be inserted with the bottom 9 facing forward in the insertion station 102 and removed with the bottom 9 facing forward after pivoting 180° in the removing station 118. The guide disc 190 is cut out over a circumferential segment and has a retaining bend 195 which supports a suction channel segment 196 which is connected via suction hoses 197 to a vacuum source not shown, for example a suction pump, so that a vacuum acts permanently within a suction channel characterized by 198 to draw off air in the direction of the suction channel 198. The suction channel 198 is ring-segment shaped and has a constant radius relative to the axis of rotation D of the transport wheel 100. The suction channel 198 is divided into two parts and is pressurized by two separate suction hoses 197 so that a constant vacuum can be maintained with high accuracy over the circumferential extent of the suction channel 198. In the transport direction T downstream of the suction channel 198 is a blow opening 199, which is recessed in the suction channel segment 198 and communicates with an overpressure source via a blow hose 200.

The suction channel 198 is formed between the insertion station 102 up to shortly in front of the connecting station 114. The blow opening 199 is located at the level of the connecting station 114.

Figure 7:
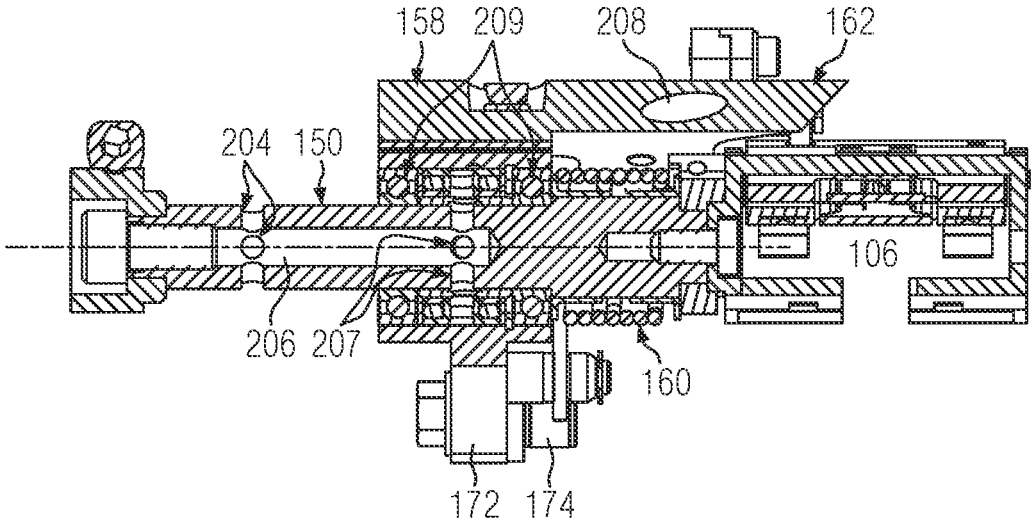
FIG. 7 shows a longitudinal sectional view of the component according to FIGS. 4 to 6.
Figure 8:
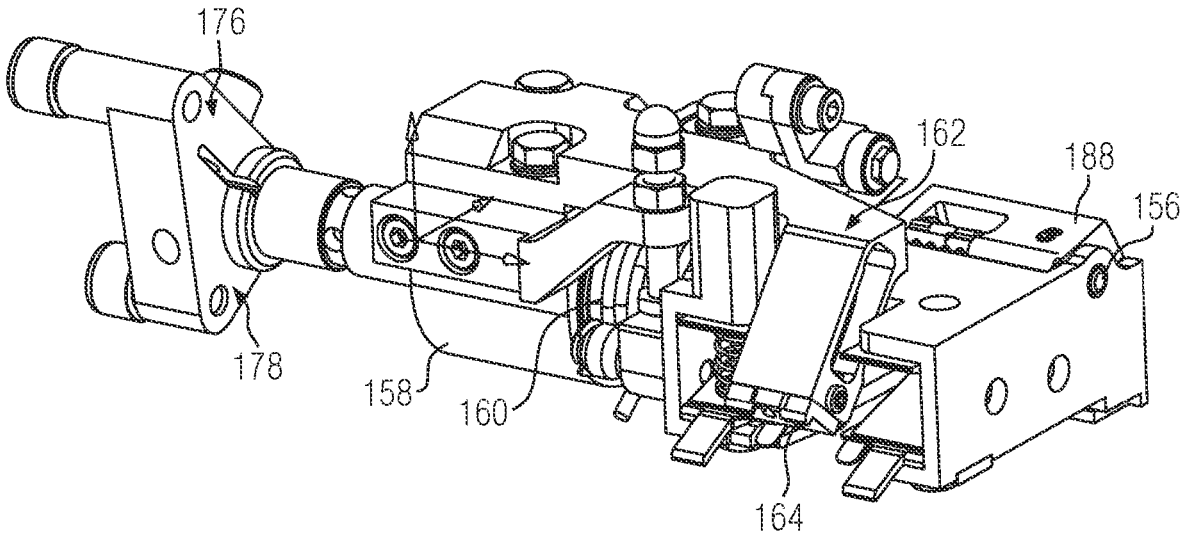
FIG. 8 shows an illustration according to FIG. 4 in the closed position.
Figure 9:
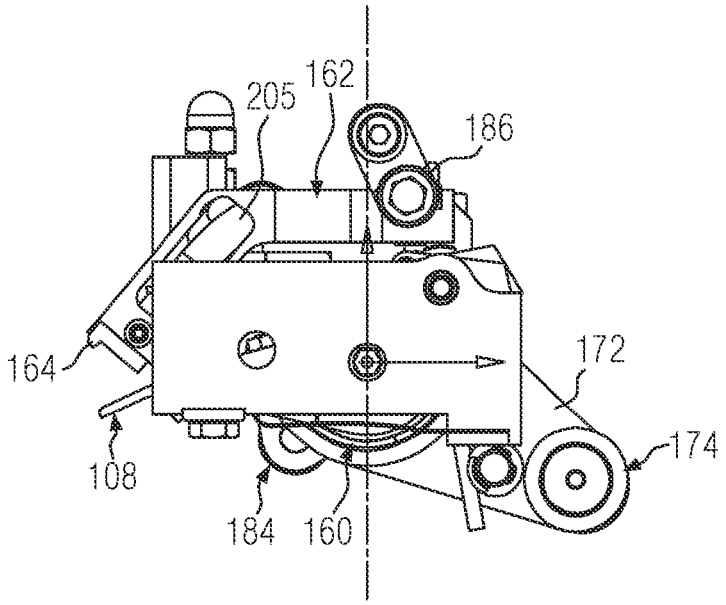
FIG. 9 shows an illustration according to FIG. 5 in the closed position.
Figure 10:
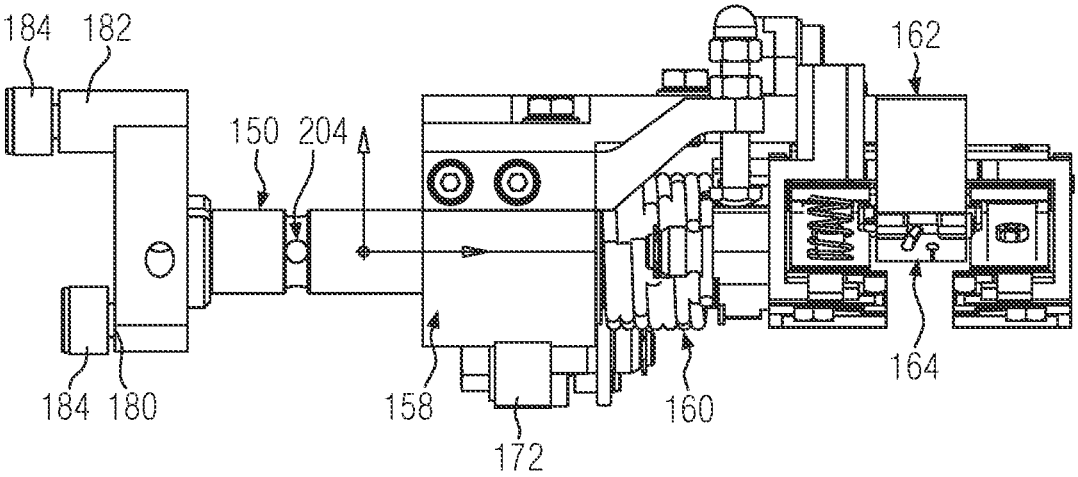
FIG. 10 shows an illustration according to FIG. 6 in the closed position.
Figure 11:
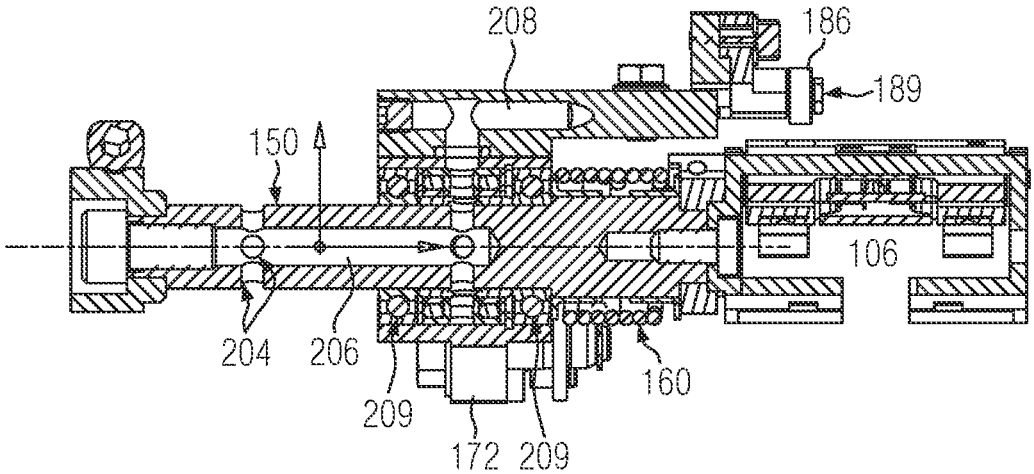
FIG. 11 shows an illustration according to FIG. 8 in the closed position.

As FIG. 12 illustrates, the transport wheel 100 peripherally covers the suction channel segment 196 and forms an air guide opening 202 that communicates with an inlet opening 204 recessed around the outer periphery of the holder 104 via non-detailed air channels within the transport wheel 100 (see FIGS. 7, 11). As can be seen in particular from FIGS. 4 and 7 and FIGS. 8 and 11, a plurality of inlet openings 204 are provided on the periphery of the axle body 150, which has a central bore 206 that communicates with radial bores 207 that communicate, at the level of the actuating sleeve 158, with a thread channel 208 recessed inside the holder 162 and formed on its last portion up to the air knot block 164 in a hose 205. As illustrated in particular by FIGS. 7 and 11, the actuating sleeve 158 is pivotally mounted relative to the axle body 150 via rolling bearings 209 and sealed with respect to the actuating sleeve 158 for lossless air flow. Similarly, the inlet openings 204 are surrounded by roller bearings shown here in FIG. 12, which serve to pivotally mount the holder 104 relative to the transport wheel 100.

FIGS. 12 and 13 show the alignment of the holder 104 relative to the pivot axis S in both the insertion station 102 and the connecting station 114, adjusted by the interaction of the respective cam followers 174, 184 with the corresponding guide grooves 192, 194. In this context, the holding shaft 106 extends strictly radially with respect to the axis of rotation D.

Figure 4:
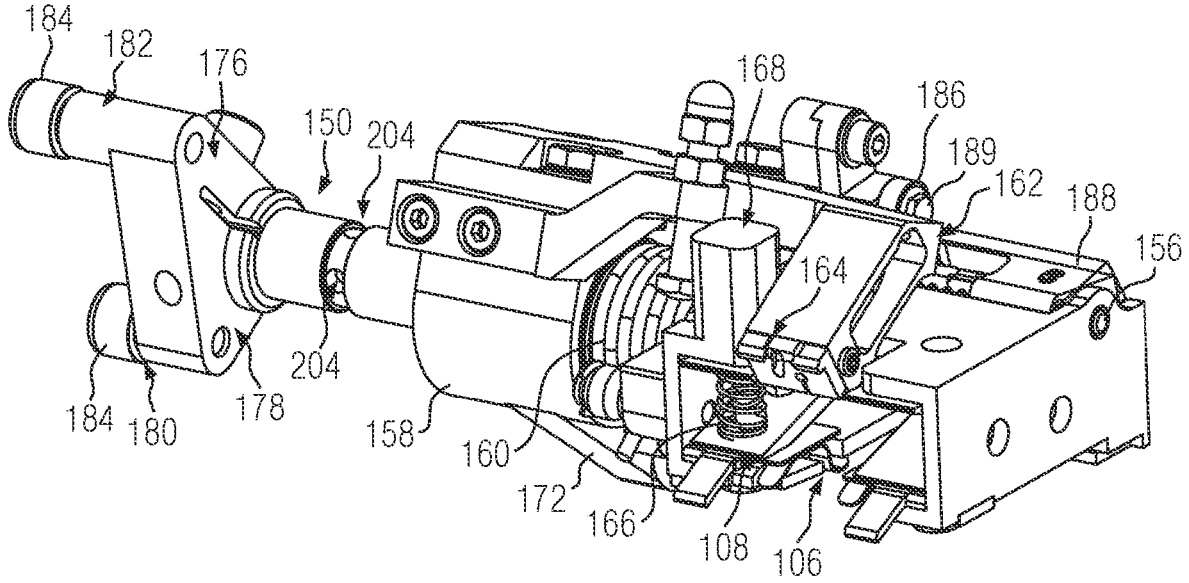
FIG. 4 shows a perspective side view of an embodiment of a holder of the embodiment according to FIGS. 2 and 3 in a position approaching the open position.
Figure 5:
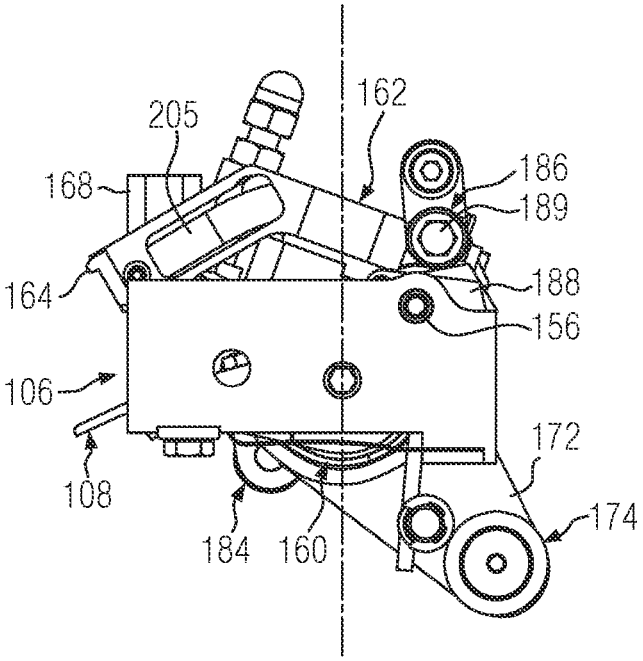
FIG. 5 shows a front view of the component according to FIG. 4.
Figure 6:
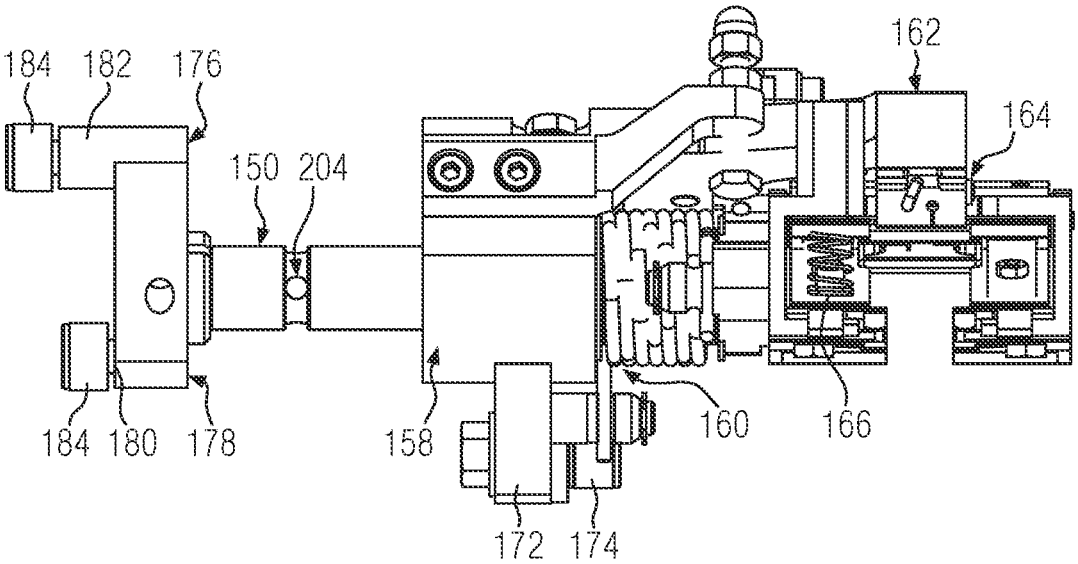
FIG. 6 shows a side view of the component according to FIGS. 4 and 5.
Figure 16:
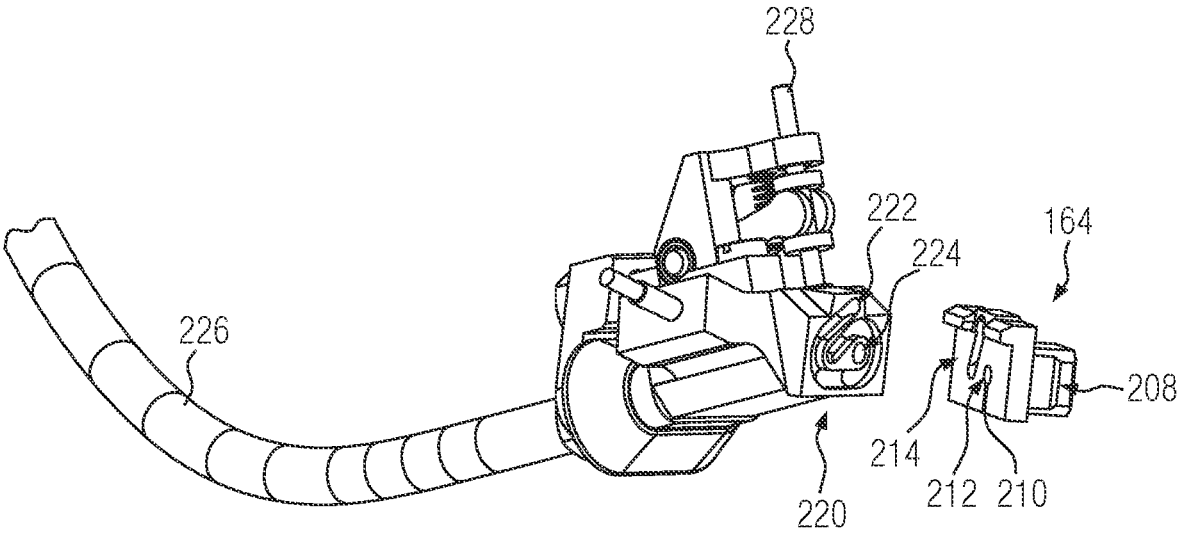
FIG. 16 shows details of the connecting station for knotting the label, wherein the air knot block 164 is shown pivoted from its actual position for display reasons.

FIGS. 4 and 16 respectively illustrate the configurations provided for guiding the thread during knotting.

Figure 15:
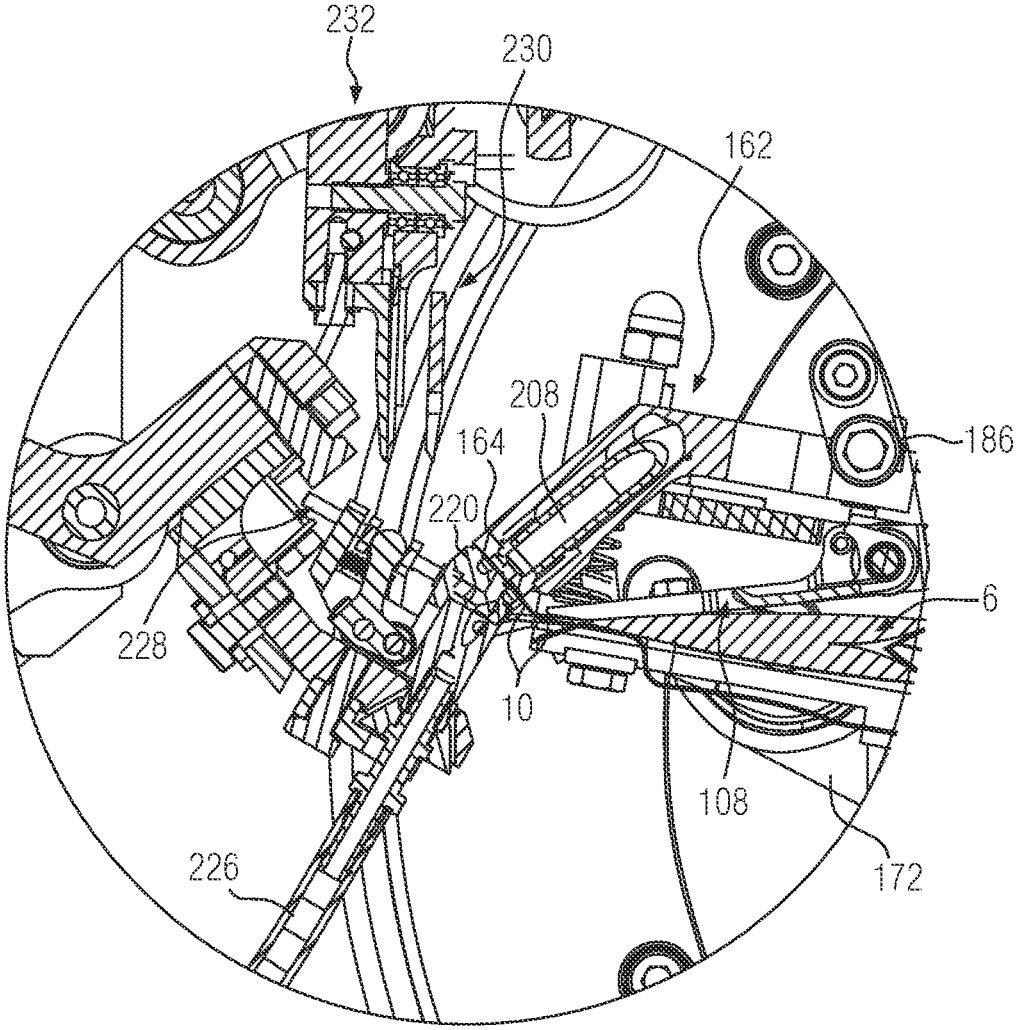
FIG. 15 shows an enlarged detail XIV as shown in FIG. 14.
Figure 17:
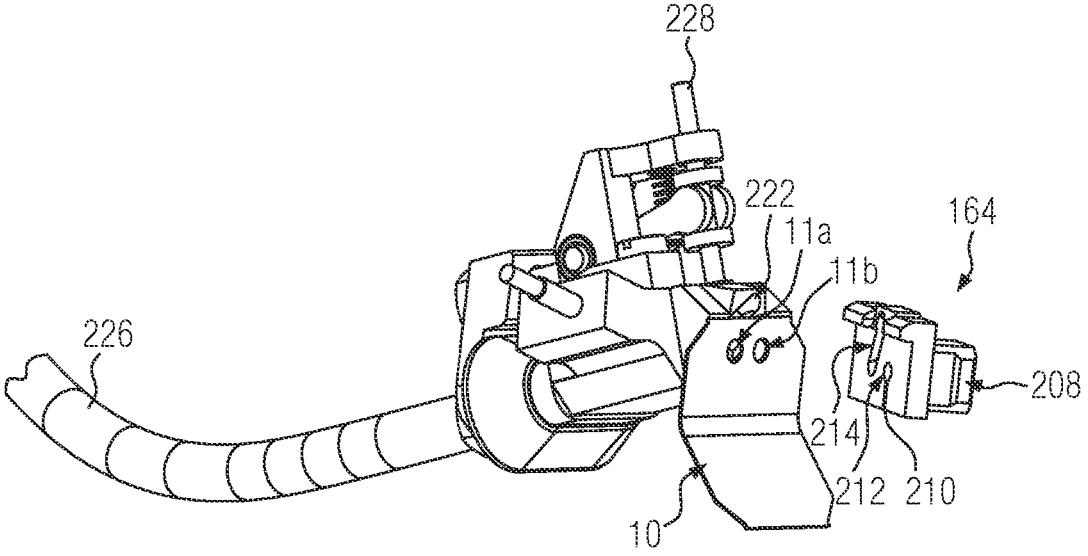
FIG. 17 shows an illustration according to FIG. 16 with a label applied against the counter plate.

FIG. 16 illustrates the air knot block 164 forming a thread opening 212 formed with a longitudinal slit 210 extending downwardly and communicating with the thread channel 208, and a deflection trough 214. On the opposite side, a counter plate 220 shown in FIGS. 15 to 17 is provided, which has a deflection trough 222 and a suction opening 224 that is connected via a suction hose 226 to a vacuum source for sucking air. The counter plate 220 is further associated with a plunger 228, which is located in the line path between the suction hose 226 and the suction opening 224 and can be fed in the direction of the line path (cf. FIG. 16).

In the insertion station, the pressure opening 206 is in operative connection with the suction channel 198 as an overpressure opening. Accordingly, a hose piece provided with the thread 8, which receives the tea dose of the filled bag therein, is not only introduced into the holding shaft 106 while forming the bottom 9 and the head 7 in the radial direction of the transport wheel 100. Rather, the thread 8 attached to the head 7 is also drawn into the thread channel 208 by the acting vacuum and through the thread opening 212. This holds the thread 8 in a predetermined position. There is no risk of the thread 8 getting caught on parts of the device during further processing of the bag 6. Due to the sustained suction pressure, the thread 8 is still in the thread channel 208 at the level of the label feeding station 112.

As FIG. 15 illustrates, the label 10 fed in this way is pivoted in the direction of the air knot block 164 by pivoting the counter plate 220. In the process, the label, which is initially flat, is deflected at its front region. The thread 8 connected to the head 7 is located in the longitudinal slot of the thread opening 212, so that the label 10 is clamped over its entire surface between the air knot block 164 and the counter plate 220.

As can be readily imagined with reference to FIG. 17, in which the air knot block 164 is pivoted away from the label 10 for display purposes, the thread 8 blown out of the thread channel 208 is blown out through the thread opening 212 and through the first through hole 11*a* of the label 10. In the counter plate 220, the thread 8 is guided in the deflection trough 222 around the suction opening 224 and beyond the plane of the label 10, where it is transferred to the deflection trough 214 of the air knot block 164 on the side opposite the label 10. The thread 8 is returned inwardly and level with the thread opening 212 within the air knot block 164 and the deflecting trough 214 provided therein, and is passed through the second through hole 11*b* and from there through the suction opening 242. The free end of the thread 8 is then located within the line path between the suction opening 224 and the suction hose 226. The plunger 228 is then actuated to clamp the thread there. Thereafter, the counter plate 220 is pivoted away from the transport wheel 100. As the counter plate 220 is moved further away from the air knot block 164, the thread 8 is pulled tighter around the label 10, thereby tightening the knot.

Thereafter, the thread 8 is connected to the label 10 by means of a knot. A cutting knife 230 of a cutting device 232 provided in the connecting station 114 cuts off an end piece of the thread 8 projecting from the label 10 so that it ends substantially flush with the knot. The cut piece of thread is thereby captured via the suction opening 224 and conveyed out through the suction hose 226.

LIST OF REFERENCE SIGNS

2 packaging unit
4 envelope
6 bag
7 head
8 thread
9 bottom
10 label
11*a* first through hole
11*b* second through hole
12 slit
14 fold
16 leg
18 longitudinal weld
20 transverse weld
100 transport wheel
102 insertion station
104 holder
106 holding shaft
108 bag clamp
110 insertion segment
112 label feeding station
114 connecting station
116 thread securing station
118 removing station
120 pivoting station
122 bag handling device
124 arms
126 arms
128 wrapping material handling device
130 wrapping material guide
132 sealing transport wheel
134 inner opener cam
136 outer opener cam
150 axle body
152 ball bearing
154 bore
156 pivot axis of the bag clamp
158 actuating sleeve
160 clamp spring
162 holder
164 air knot block
166 hold-down spring
168 receiving cylinder
170 guide projections
172 actuating arm
174 cam follower
176 guide arm
178 guide arm
180 guide pin
182 guide pin
184 cam follower
186 cam
188 free lever arm
189 pivot axis
190 guide disc
192 guide groove to cam follower 184
194 guide groove to cam follower 174
195 retaining bend
196 suction channel segment
197 suction hose
198 suction channel
199 blow opening
200 blow hose
202 air guide opening
204 inlet opening
205 hose
206 bore
207 radial bore
208 thread channel
209 rolling bearing
210 longitudinal slit
212 thread opening
214 deflection trough
220 counter plate
222 deflection trough
224 suction opening
226 suction hose
228 plunger
230 cutting knife
232 cutting device
D axis of rotation
T transport direction
S pivot axis

What is claimed is:

1. A device for transporting unfinished bags within a machine for producing a bag filled with brewable material comprising: at least one transport wheel which comprises, distributed over its circumference, a plurality of holders each holding at least one of the unfinished bags, wherein an insertion station in which one of said unfinished bags is inserted into a holder of the plurality of holders in a radial direction to form the bag with at least one chamber between a head and a bottom of said bag, a label feeding station in which a label is fed to said head, a connecting station, in which a thread is connected to the label and/or the bag, and a removing station, in which the bag is removed from the transport wheel, are provided distributed in a circumferential direction around the transport wheel, wherein each holder of the plurality of holders has associated therewith a thread channel connectable to a source of vacuum and a source of overpressure and adapted to receive the thread connected to the bag;

wherein the thread channel has a thread opening for introducing the thread and an opposite air guide opening, which can be brought into operative connection with a vacuum opening or an overpressure opening as a result of a rotation of the transport wheel.

2. The device according to claim 1, wherein the air guide opening is recessed on a surface extending radially with respect to an axis of rotation of the transport wheel and in that, in operative connection, the vacuum opening or the overpressure opening is provided opposite the air guide opening.

3. The device according to claim 2, wherein the vacuum opening is formed as an elongated open channel and that the air guide opening is in operative connection with the channel in the course of the rotation of the transport wheel from the insertion station upstream of the connecting station.

4. The device according to one claim 1, wherein the thread channel in the connecting station is in operative connection with an overpressure opening, and in that the connecting station has a thread guide which is to be arranged opposite a thread opening of the thread channel with interposition of the label and which deflects the thread blown out of the thread channel in a direction of the label.

5. The device according to claim 1, wherein the transport wheel comprises a bore for each holder of the plurality of holders, in which an axle body carrying the holder is mounted so as to be pivotable about a pivot axis, in that a guide is provided which leads the holder in an orientation with respect to the pivot axis during a rotation of the transport wheel such that an air guide opening, arranged eccentrically with respect to the pivot axis, of the thread channel in the insertion station is in operative connection with a vacuum opening and in the connecting station with an overpressure opening.

6. The device according to claim 5, wherein the axle body is connected to at least one guide arm extending transversely to the pivot axis of the axle body, a free end of which is guided in the guide.

7. A device for transporting unfinished bags within a machine for producing a bag filled with brewable material comprising: at least one transport wheel which comprises, distributed over its circumference, a plurality of holders each holding at least one of the unfinished bags, wherein an insertion station in which one of said unfinished bags is inserted into a holder of the plurality of holders in a radial direction to form the bag with at least one chamber between a head and a bottom of said bag, a label feeding station in which a label is fed to said head, a connecting station, in which a thread is connected to the label and/or the bag, and a removing station, in which the bag is removed from the transport wheel, are provided distributed in a circumferential direction around the transport wheel, wherein the transport wheel comprises a bore for each holder, in which an axle body carrying the holder is mounted so as to be pivotable about a pivot axis, in that a guide is provided which leads the holder in an orientation with respect to the pivot axis during the rotation of the transport wheel such that an air guide opening, arranged eccentrically with respect to the pivot axis, of a thread channel in the insertion station is in operative connection with a vacuum opening and in the connecting station with an overpressure opening.

8. The device according to claim 7, wherein each holder of the plurality of holders has associated therewith the thread channel connectable to a source of vacuum and a source of overpressure and adapted to receive the thread connected to the bag.

9. The device according to claim 8, wherein the thread channel has a thread opening for introducing the thread and an opposite air guide opening, which can be brought into operative connection with a vacuum opening or the overpressure opening as a result of the rotation of the transport wheel.

10. The device according to claim 9, wherein the air guide opening is recessed on a surface extending radially with respect to an axis of rotation of the transport wheel and in that, in operative connection, the vacuum opening or the overpressure opening is provided opposite the air guide opening.

11. The device according to claim 10, wherein the vacuum opening is formed as an elongated open channel and that the air guide opening is in operative connection with the channel in the course of the rotation of the transport wheel from the insertion station upstream of the connecting station.

12. The device according to one claim 11, wherein the thread channel in the connecting station is in operative connection with the overpressure opening, and in that the connecting station has a thread guide which is to be arranged opposite the thread opening of the thread channel with interposition of the label and which deflects the thread blown out of the thread channel in a direction of the label.

13. The device according to claim 12, wherein the axle body is connected to at least one guide arm extending transversely to the pivot axis of the axle body, a free end of which is guided in the guide.

14. A device for transporting unfinished bags within a machine for producing a bag filled with brewable material comprising:

at least one transport wheel which comprises, distributed over its circumference, a plurality of holders each holding at least one of the unfinished bags, wherein an insertion station in which one of said unfinished bags is inserted into a holder of the plurality of holders in a radial direction to form the bag with at least one chamber between a head and a bottom of said bag, a label feeding station in which a label is fed to said head, a connecting station, in which a thread is connected to the label and/or the bag, and a removing station, in which the bag is removed from the transport wheel, are provided distributed in a circumferential direction around the transport wheel, wherein each holder of the plurality of holders has associated therewith a thread channel connectable to a source of vacuum and a source of overpressure and adapted to receive the thread connected to the bag, wherein the thread channel in the connecting station is in operative connection with an overpressure opening, and in that the connecting station has a thread guide which is to be arranged opposite a thread opening of the thread channel with interposition of the label and which deflects the thread blown out of the thread channel in a direction of the label.

15. The device according to claim 14, wherein the thread channel has a thread opening for introducing the thread and an opposite air guide opening, which can be brought into operative connection with a vacuum opening or an overpressure opening as a result of a rotation of the transport wheel.

16. The device according to claim 15, wherein the air guide opening is recessed on a surface extending radially with respect to an axis of rotation of the transport wheel and in that, in operative connection, the vacuum opening or the overpressure opening is provided opposite the air guide opening.

17. The device according to claim 16, wherein the vacuum opening is formed as an elongated open channel and that the air guide opening is in operative connection with the channel in the course of the rotation of the transport wheel from the insertion station upstream of the connecting station.

18. The device according to claim 14, wherein the transport wheel comprises a bore for each holder of the plurality of holders, in which an axle body carrying the holder is mounted so as to be pivotable about a pivot axis, in that a guide is provided which leads the holder in an orientation with respect to the pivot axis during a rotation of the transport wheel such that an air guide opening, arranged eccentrically with respect to the pivot axis, of the thread channel in the insertion station is in operative connection with a vacuum opening and in the connecting station with an overpressure opening.

19. The device according to claim 18, wherein the axle body is connected to at least one guide arm extending transversely to the pivot axis of the axle body, a free end of which is guided in the guide.

* * * * *